United States Patent [19]

Nakane et al.

[11] 4,409,785

[45] Oct. 18, 1983

[54] METHOD OF STARTING A FLYER FRAME

[75] Inventors: Katsumi Nakane, Okazaki; Hideo Hirano, Kariya, both of Japan

[73] Assignee: Kabushiki Kaisha Toyoda Jidoshokki Seisakusho, Kariya, Japan

[21] Appl. No.: 261,287

[22] Filed: May 6, 1981

[30] Foreign Application Priority Data

May 16, 1980 [JP] Japan ..... 55-65839

[51] Int. Cl.[3] ..... D01H 7/50

[52] U.S. Cl. ..... 57/78; 57/96

[58] Field of Search ..... 57/78, 79, 80, 81, 88, 57/92, 93, 94, 100, 264, 276

[56] References Cited

U.S. PATENT DOCUMENTS

| | | | |
|---|---|---|---|
| 1,222,405 | 4/1917 | Jackson | 57/78 |
| 3,015,203 | 1/1962 | Heiberg | 57/93 |
| 3,134,217 | 5/1964 | Williamson | 57/79 |
| 3,538,699 | 11/1970 | Cunningham | 57/78 X |
| 3,738,095 | 6/1973 | Lohest | 57/93 X |
| 4,023,342 | 5/1977 | Schenkel | 57/264 |
| 4,196,572 | 4/1980 | Hunt | 57/96 |
| 4,254,615 | 3/1981 | Adolf et al. | 57/93 X |

*Primary Examiner*—Donald Watkins

*Attorney, Agent, or Firm*—Wenderoth, Lind & Ponack

[57] ABSTRACT

The slack of a rove is actually developed by a time difference between the time point at which the rove is supplied simultaneously with the pushing down of a start button of a flyer frame, and the time point at which the winding of the rove commences after the presser has been pressed against the bobbin. The removing of the rove slack must be performed before the flyer frame attains its normal high speed operation. On the basis of this knowledge, the method according to this invention includes operating the flyer frame at a relatively low speed for a predetermined time period before the flyer frame is rotated at its normal high speed. During this time period, any slack of the rove can be removed.

4 Claims, 15 Drawing Figures

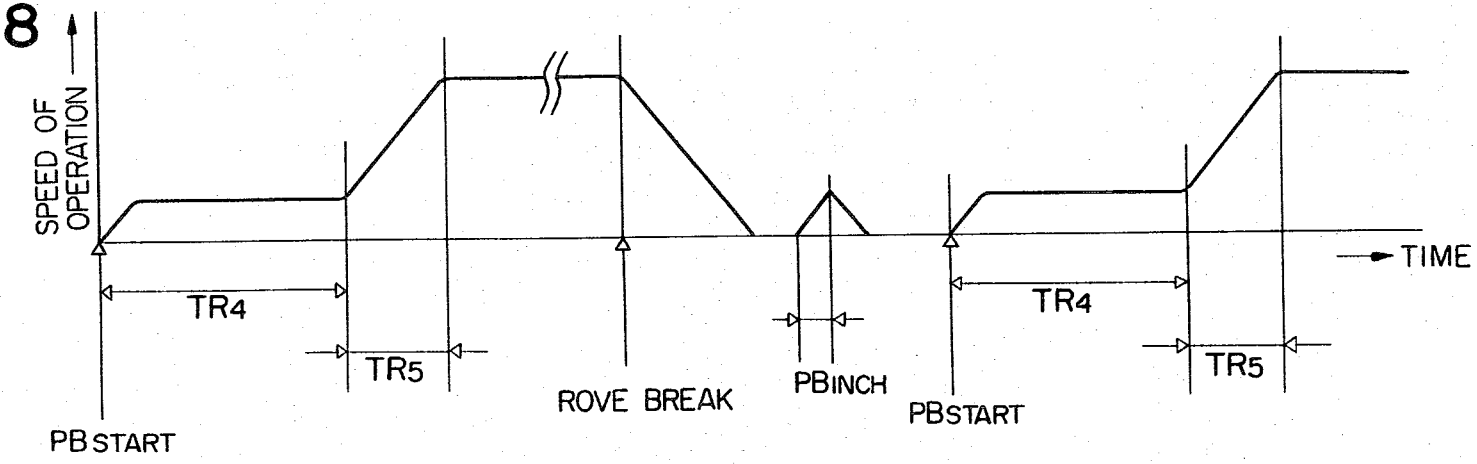
FIG. 8
FIG. 11
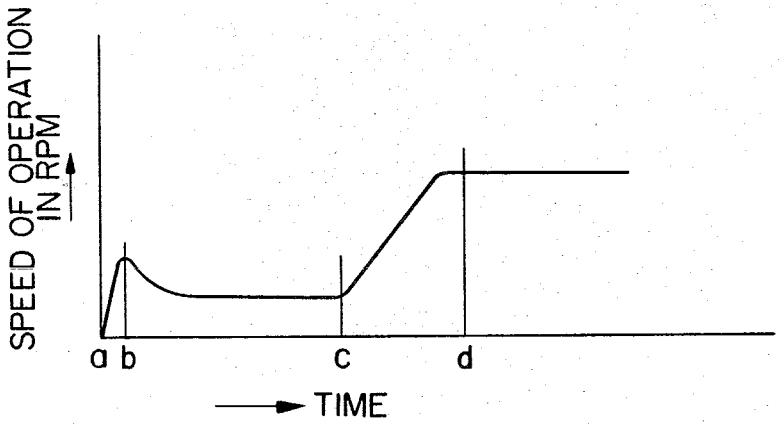

METHOD OF STARTING A FLYER FRAME

BACKGROUND OF THE INVENTION

This invention relates to an improved method of starting or re-starting a flyer frame.

In a flyer frame, when bobbins fitted onto respective spindles on the bobbin support rail become full, they are doffed and empty bobbins are fitted in their place onto the respective spindles. Then, the end of a rove connected to the roller part of the flyer frame is attached to each of the empty bobbins. Heretofore, this attaching operation has been carried out manually by the operator for every rove end.

Referring to FIGS. 1 and 2, there are views illustrating two modes of the attaching operation. In the mode of FIG. 1, a length of a rove greater than the circumference of the empty bobbin 1 is supplied through the roller part by the inching operation of the main motor of the flyer frame so that the supplied rove can pass across the rove end, whereby the rove end is enabled to be manually pressed against the cylindrical surface of the empty bobbin by the supplied rove as well as by a well known presser 3 biased against the empty bobbin.

In the mode shown in FIG. 2, a bobbin 1 is employed which has a rove holding member, such as a napped cloth 4, circumferentially disposed therearound in a position allowing the presser 3 to contact the napped cloth 4 when th bobbin rail is in a position at the begining of the winding operation. At the doffing, the rove is cut at a portion which is a suitable distance away from the extremity of the flyer presser 3, and then the operator strongly presses the cut end against the napped cloth 4 with the presser 3. In both of the two modes illustrated in FIGS. 1 and 2, the operator must carry out the abovenoted manual operation for every empty bobbin. Thus, the operator is required to perform the very complicated rove end attaching operation. Furthermore, since the starting operation of the flyer frame is allowed to commence only upon the completion of the above manual operation for all of the empty bobbins, the down time of the flyer frame is relatively long, resulting in a lower operation efficiency.

In order to remove the abovenoted disadvantages, it has been desired to automatically attach the rove end around the empty bobbin to thereby allow the automatic operation of the flyer frame. However, even through the automatic attaching of the rove end around the empty bobbin has been tried on the bobbin shown in FIG. 2, a favorable result could not be obtained because of the following reason. That is, after the doffing, even if the bobbin rail is raised so as to position the napped cloth 4 of the empty bobbin 1 at the same height as the presser 3 and then the flyer frame is started, a rove slackening phenomenon has occurred between the flyer top and the front rollers (in the case of the flyer frame shown in FIGS. 6A–6E) at each of half or more of the total number of spindles in the flyer frame. Thus, the operator has been required to stop the flyer frame to take necessary manual steps to remove the slack to the rove. Otherwise, the slackened rove would be swung about the flyer neck by means of the centrifugal force applied thereon, resulting in a rove break.

It is accordingly a principal object of this invention to provide a method of starting a flyer frame, which can automatically remove any slack of a rove occurring in the flyer frame and allows the rove end to be automatically attached to the bobbin.

SUMMARY OF THE INVENTION

It has been found that the slack of a rove is actually caused by a time difference between the time point at which the rove is supplied through the top rollers simultaneously with the pushing down of a starting button and the time point at which the winding of the rove commences after the presser has been pressed against the bobbin. Also, it has been found that in order to achieve the abovenoted object, the slack of the rove must be removed before the flyer frame attains its normal high speed operation, because during its normal high speed operation, any slackened rove will be subject to the maximum centrifugal force. On the basis of this knowledge, the method according to this invention includes operating the flyer frame at a relatively low speed for a predetermined time period before the flyer frame is rotated at its normal high speed. During this time period, any slack of the rove can be removed because in the flyer frame the winding of the rove on the bobbin is carried out at a speed which is slightly faster than the rove supply speed (e.g., the speed ratio is 1:1.02).

BRIEF DESCRIPTION OF THE DRAWINGS

The present invention will become more readily apparent from the following detailed description taken in conjunction with the accompanying drawings, in which:

FIG. 8 is a view illustrating the operation speed-time characteristics of the flyer frame according to the first embodiment of the starting method of this invention;

FIG. 11 is a view illustrating the operation speed-time characteristics of the flyer frame according to the second embodiment of this invention.

DESCRIPTION OF THE PREFERRED EMBODIMENTS

Figure 5:
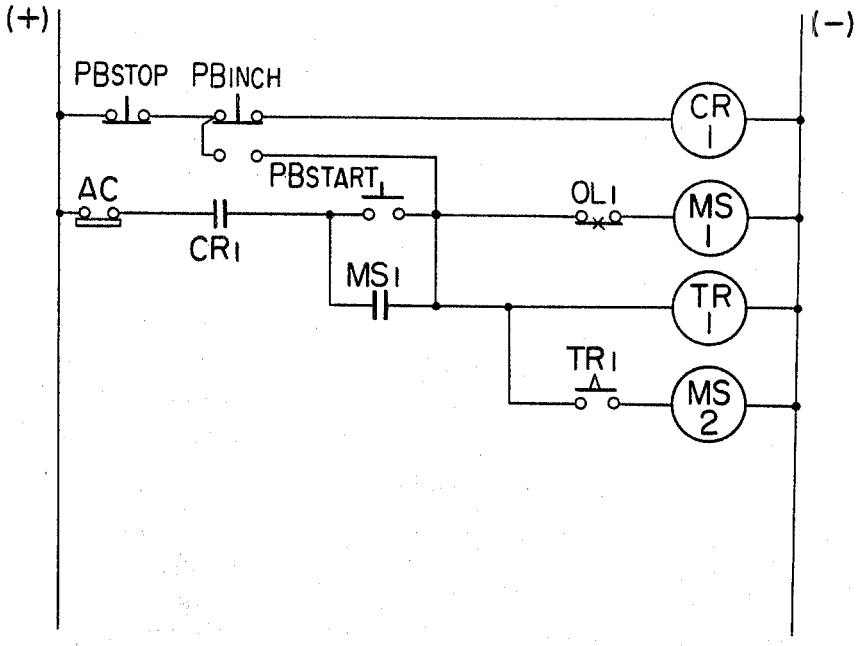
FIG. 5 PRIOR ART
FIG. 5 is a control circuit for the power circuit of FIG. 4.
Figure 6A:
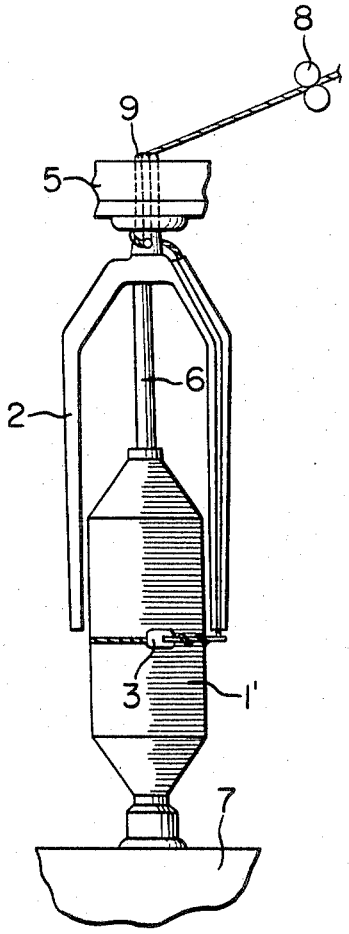
FIGS. 6A to 6E are elevational view illustrating the sequence of operation steps from the doffing of the full bobbin to the attachment of the rove end of the empty bobbin.
Figure 6B:
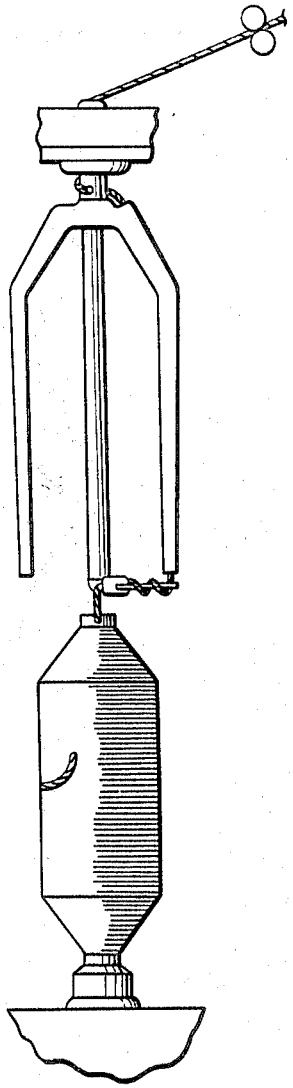
Figure 6C:
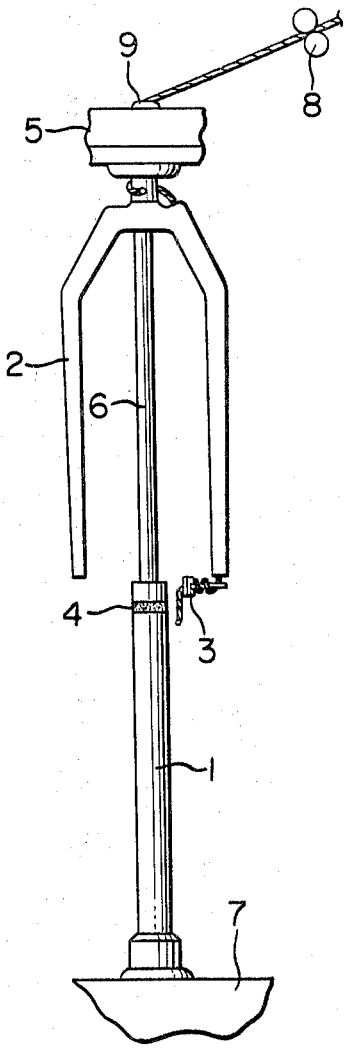
Figure 6D:
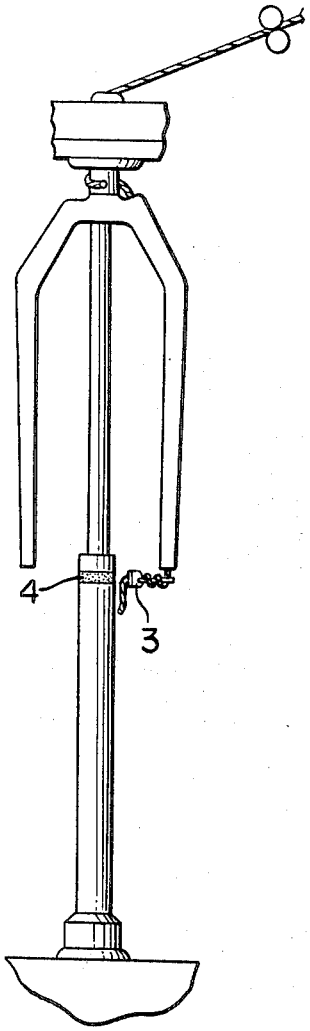
Figure 6E:
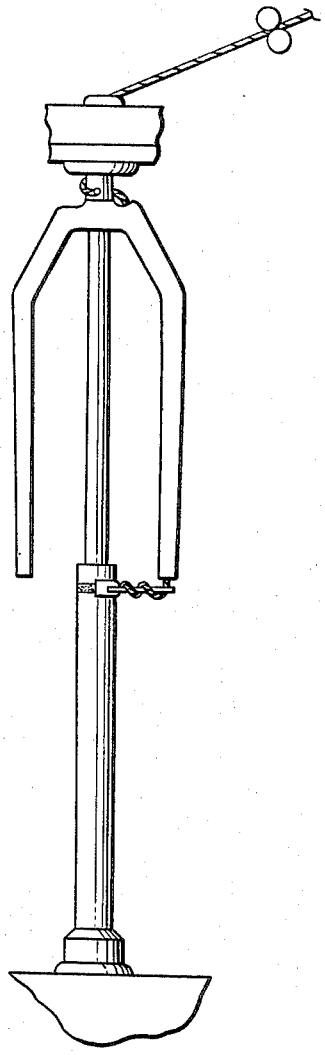

In a flyer frame of the type wherein the top of a flyer is supported by a support rail, the necessary steps to attach the end of a rove around an empty bobbin are carried out in the sequence shown in FIGS. 6A to 6E. When the bobbin becomes full, a signal indicating the full bobbin 1' is issued from an auto-counter AC (FIG. 5) to stop the flyer frame (FIG. 6A). Then, a bobbin rail 7 is lowered to the position shown in FIG. 6B, in which the top of the full bobbin 1' is away from the bottom of a flyer guide leg 6. Upon such a lowering, the rove is cut between a presser 3 and the outermost rove layer, and the cut end having length of several centimeters is suspended from the presser 3. In this condition, the full bobbin 1' on the bobbin rail 7 is replaced by an empty bobbin 1 (FIG. 6C), and thereafter, the bobbin rail 7 is lowered until the napped cloth 4 circumferentially mounted on the empty bobbin 1 reaches a height corresponding to the position of the presser 3 (FIG. 6D). Then, the rove end is caught by the napped cloth 4 as shown in FIG. 6E when the presser 3 is pressed against the napped cloth 4. When the flyer frame is started, the empty bobbin 1 starts to rotate to wind the rove thereon.

Heretofore, to carry out the step of FIG. 6E, the operator has been required to perform heavy manual labor in moving the presser 3 toword the empty bobbin 1 and attaching the rove end to the napped cloth 4 while strongly pressing against the napped cloth 4 so that the rove end is firmly caught by the napped cloth 4.

Figure 1:
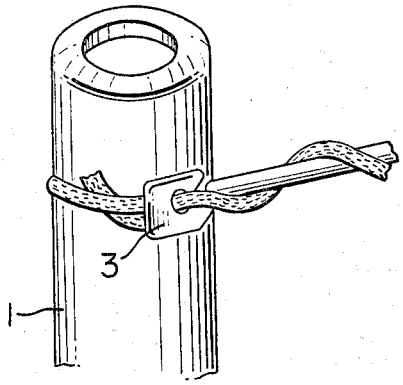
FIG. 1 PRIOR ART
FIGS. 1 and 2 are perspective views illustrating two modes of a manual rove attaching operation according to the prior art.
Figure 2:
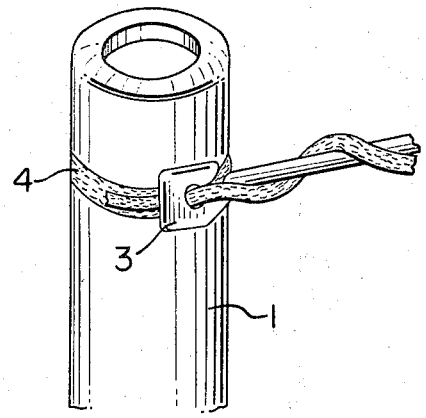
FIG. 2 PRIOR ART
Figure 3:
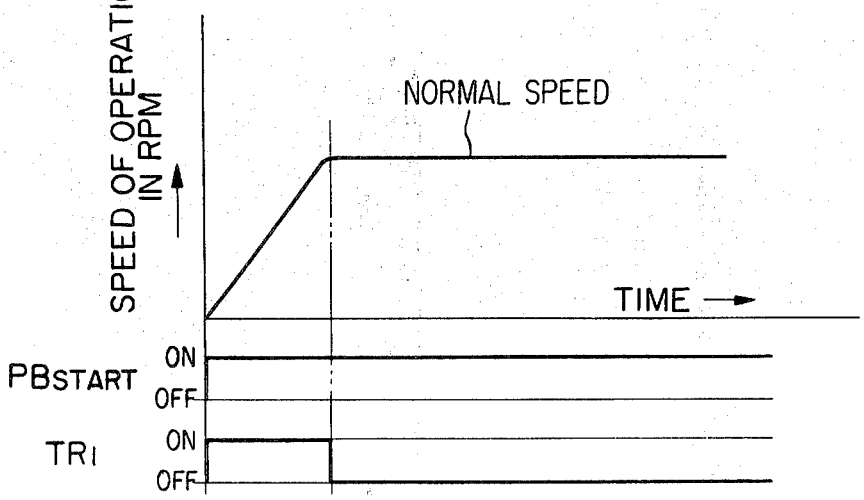
FIG. 3 PRIOR ART
FIG. 3 is a view illustrating operation speedtime characteristics of a flyer frame according to the prior art method of starting the flyer frame.
Figure 4:
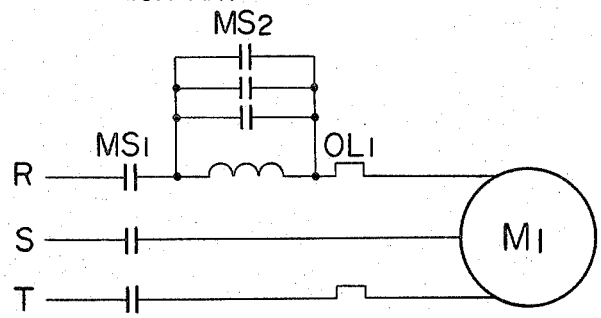
FIG. 4 PRIOR ART
FIG. 4 is a power circuit for operating the flyer frame on the basis of the characteristics shown in FIG. 3.

Furthermore, it has been the practice to operate the flyer frame in a manner shown in FIG. 3 by the use of the power and control circuits of FIGS. 4 and 5. That is, upon the pushing down of a start button $PB_{START}$, an electromagnetic contactor MS1 for a cushion start of a main motor M1 of the flyer frame is energized through the normally closed contacts of an overload relay OL1 to close the MS1 contacts, thereby energizing the main motor M1. Thus, the main motor M1 is cushion started as is well known in the art. At the same time, a timer TR1 is energized. When the timer TR1 counts up to a set time, an electromagnetic contactor MS2 for the normal speed operation of the main motor M1 is energized in lieu of the contactor MS1. Thus, the main motor M1 and accordingly the flyer frame are driven at the normal operation speed as shown in FIG. 3.

Figure 7:
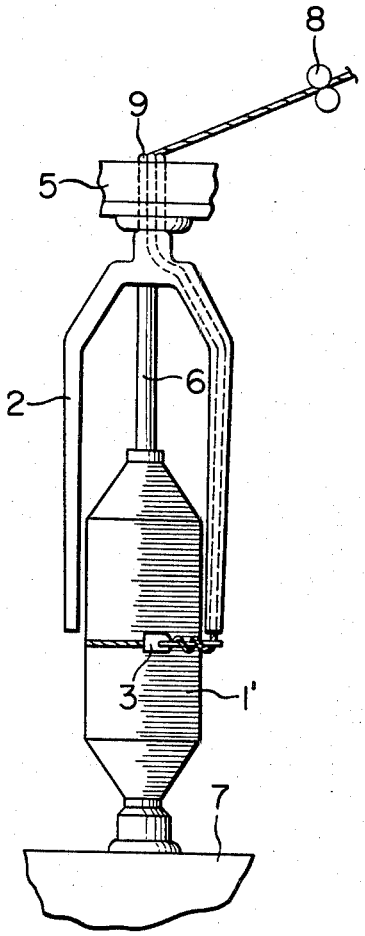
FIG. 7 is an elevational view of a flyer of the hollow pipe type.

Assuming that the flyer frame in the state shown in FIG. 6D is started in the manner described in conjunction with FIGS. 3 to 5, the slack of a rove will occur, as stated in the beginning of the specification, since there is the time difference between the time point at which the rove is supplied through the top rollers 8 simultaneously with the pushing down of the start button $PB_{START}$, and the time point at which the winding of the rove commences after the presser 3 has been pressed against the bobbin 1. When the flyer frame attains its normal operation speed at the set time of the timer TR1, the slack of the rove, present at the flyer neck in the flyer frame of FIG. 6 and between the top rollers 8 and the flyer top in the flyer frame of FIG. 7, increases to more than during the cushion starting since a higher centrifugal force is applied to the slack of the rove. This results in the rove break.

Figure 9:
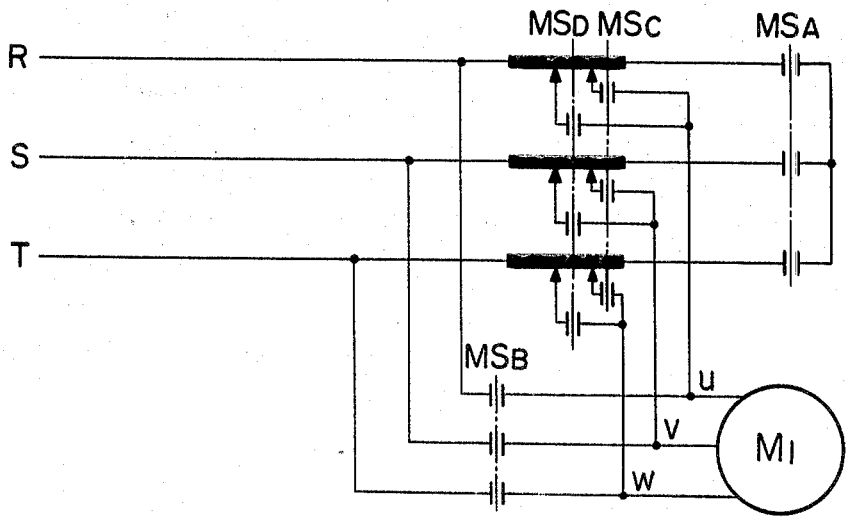
FIG. 9 is a power circuit for operating the flyer frame on the basis of the characteristics shown in FIG. 8.
Figure 10:
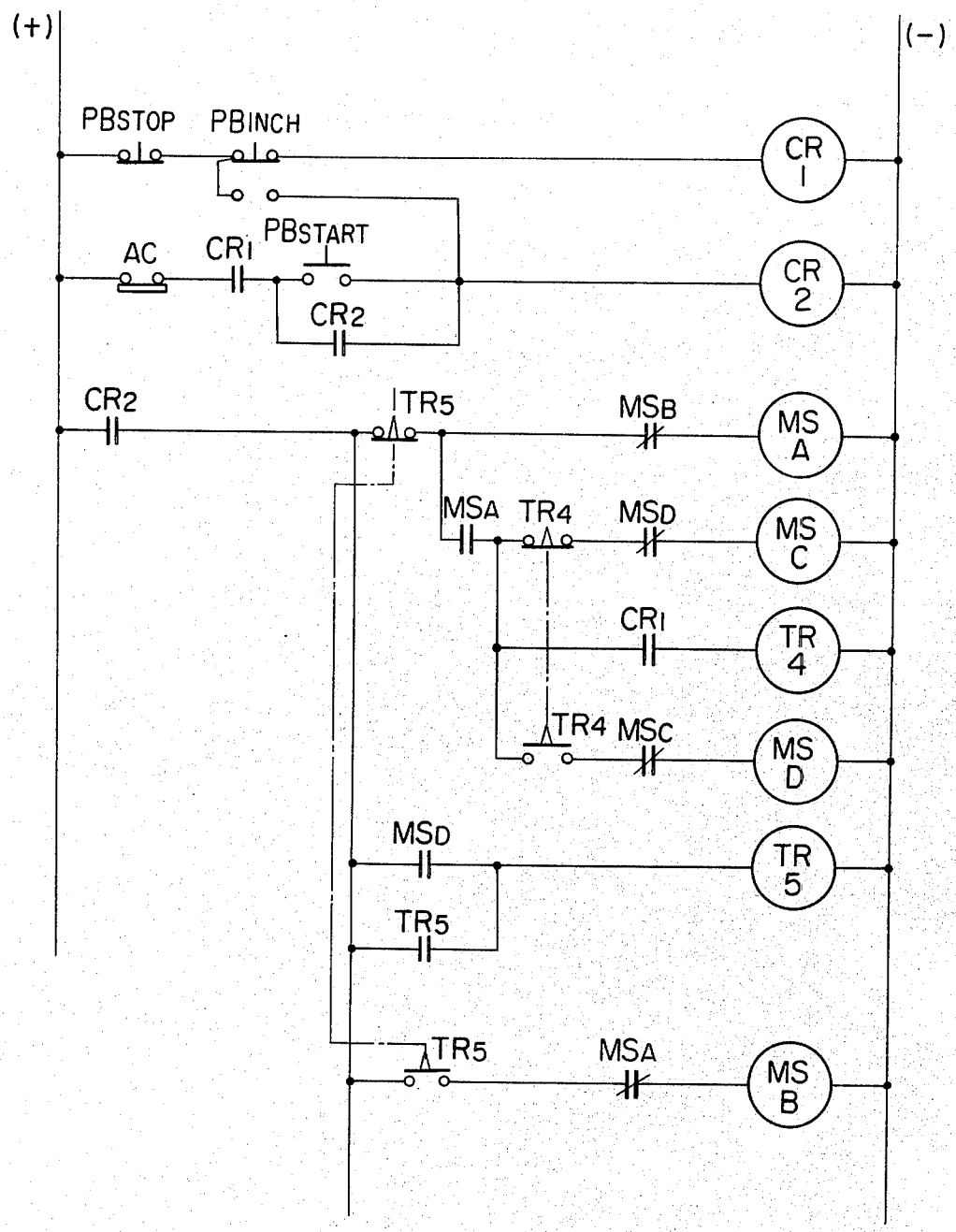
FIG. 10 is a control circuit for controlling the power circuit of FIG. 9 so that the flyer frame is started in accordance with the first embodiment of this invention.

According to the first embodiment of the starting method of this invention, the flyer frame is operated in accordance with the operation speed-time relationships shown in FIG. 8. The first embodiment of this invention will be described with reference to FIGS. 8 to 10.

Assuming that the flyer frame is in the state shown in FIG. 6D, when the start button $PB_{START}$ is pushed down, a control relay CR2 is energized and an electromagnetic contactor $MS_A$ is also energized through the normally closed contacts of a timer TR5 and a contactor $MS_B$. Therefore, an electromagnetic contactor $MS_C$ for a low speed operation of the main motor M1 and a timer TR4 are energized, whereby the main motor M1 reaches a predetermined low speed after the lapse of a rise time. When the timer TR4 counts up to a set time, a contactor $MS_D$ for a cushion start of the main motor is energized in lieu of the contactor $MS_C$ and at the same time a timer TR5 is energized. Therefore, the cushion start of the main motor commences. When the timer TR5 counts up to a set time, an electromagnetic contactor $MB_B$ for the normal speed operation of the main motor is energized to drive the main motor at the normal operation speed.

At the same time as the commencement of the flyer frame starting, the supply of the rove commences. However, a certain period of time is required until the presser 3 is pressed against the napped cloth 4. Also, after this period of time, an additional time period is required until the rove end is firmly caught by the napped cloth 4. Therefore, during these time periods, the rove supplied through the front rollers 8 is slackened between the front rollers 8 and the flyer top 9 in the case of the flyer frame shown in FIG. 7 and at the flyer neck in the case of the flyer frame shown in FIG. 6. However, since the flyer frame is adapted to drive to bobbin at a rove winding speed slightly faster than a rove supply speed and since the flyer frame is operated at the predetermined low speed for the period of the set time of the timer TR4 minus the rise time of the motor prior to the normal speed operation of the flyer frame, any slack of the rove can be removed during said period.

The starting method illustrated in FIG. 8 is also applicable to the re-starting of the flyer frame, e.g. after a broken rove has been ended. Heretofore, since the flyer frame has been started in the manner shown in FIG. 3 by pushing down the start button $PB_{START}$ (FIG. 5), the ended portion of the rove would be broken again if the manner of FIG. 3 was applied to the re-starting of the flyer frame after the rove ending. Therefore, repeated inching operations have had to be carried out until the ended portion of the rove is wound on the bobbin so that a rove break does not occur again.

Referring back to FIG. 8, if a rove break occurs, the flyer frame will be stopped in the known manner. After the stoppage of the flyer frame, a switch $PB_{INCH}$ (FIG. 10) is operated to inch the flyer into a favourable angular position to perform subsequent operations such as a rove ending. After the rove ending, the start button $PB_{START}$ can be pushed down, since according to this invention the flyer frame attains the normal operation speed after it has been operated for the predetermined time period at the relatively low speed, which does not apply a sufficient tension on the ended portion of the rove to cause it to be broken again.

In the first embodiment, although the contactor $MS_C$ for the low speed operation is energized at the start, the contactor $MS_D$ can be energized prior to the energization of the contactor $MS_C$ to provide a cushion start.

The second embodiment of this invention will be described with reference to FIGS. 11 and 12.

The second embodiment is the same as the first embodiment, except that when the start button $PB_{START}$ is pushed down, the contactor $MS_B$ for the normal speed operation is first energized so that the main motor is abruptly accelerated. This increased acceleration applies a sufficient centrifugal force on the presser 3 to cause it to be moved to the napped cloth 4 in a shorter time and pressed more strongly thereagainst. Thus, it will be understood that according to the second embodiment, the degree of rove slacking upon the starting of the flyer frame is decreased and the rove end is firmly held by the napped cloth 4.

Figure 12:
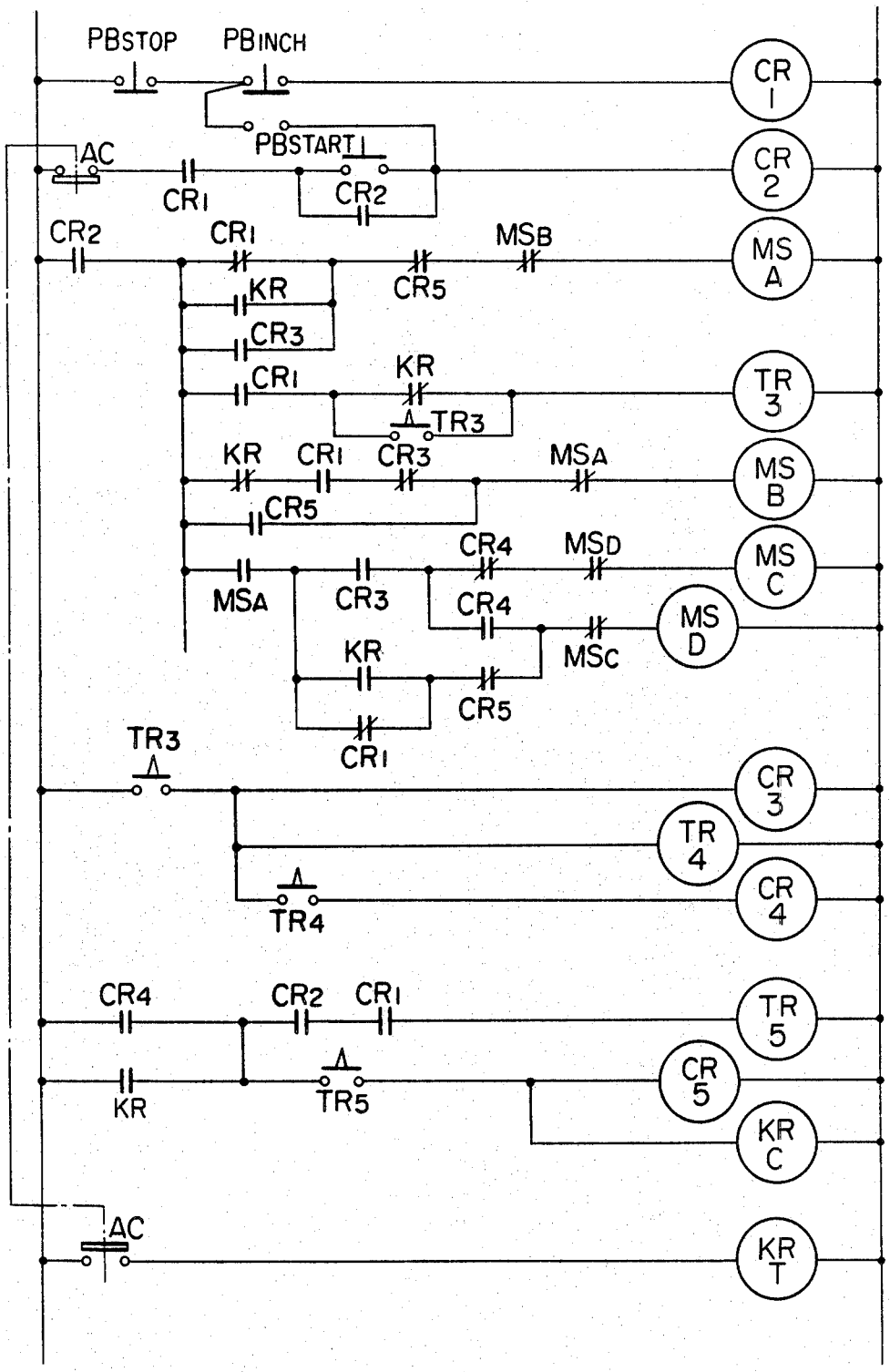
FIG. 12 is a control circuit for controlling the power circuit of FIG. 9 so that the flyer frame is started in accordance with the second embodiment of this invention.

Assuming that the flyer frme is in the state shown in FIG. 6D, in FIGS. 11 and 12, when the start button $PB_{START}$ is pushed down, the control relay CR2 is energized to thereby energize the electromagnetic contactor $MS_B$ for the normal speed operation of the flyer frame and the timer TR3 through the closed normally open contacts of the relay CR2. This causes the main motor M1 (FIG. 9) of the flyer frame to be started with the full voltage and abruptly accelerated within a decreased time period of b-a as shown in FIG. 11. Thus, the presser 3 can be quickly and strongly pressed against the napped cloth 4 of the empty bobbin 1. When the timer TR3 counts up to a set time, the contactor $MS_B$ is deenergized and the contactor $MS_C$ for the low speed operation of the flyer frame is energized under the control of the motor primary voltage. Thus, the main motor M1 is driven at the low speed for the predetermined time period determined by the set time of the timer TR4, during which any slack of the rove can be removed in the same manner as in the first embodiment. When the timer TR4 counts up to the set time at the time point c, the contactor $MS_C$ for the low speed operation is deenergized and the contactor $MS_D$ for the cushion start of the flyer frame is energized to thereby connect the motor M1 to the higher voltage tap of the three-phase autotransformer (FIG. 9), increasing the motor primary voltage. This allows the speed of the flyer frame motor M1 to be gradually increased to the normal operation speed. The timer TR5, energized at the same time as the counting up of the timer TR4, up at a time point d, at which point the motor M1 reaches the normal operation speed and the contactor $MS_B$ for the normal speed operation is energized in lieu of the contactor $MS_D$. Then, the flyer frame continues to operate at this normal operation speed until the bobbin becomes full with the rove.

In FIG. 12, letters $KR_C$ denote a catch coil, $KR_T$ a trip coil, and DR contacts of a keep relay. By these elements, the starting for winding the rove on the empty bobbin is distinguished from the re-starting after the stoppage due to the rove break possibly occurring during the normal speed operation. After the catch of the keep relay (after the completion of the starting for winding), the cushion starting is carried out during the time period d-c as shown in FIG. 11.

In these embodiments of this invention, although the autotransformer starting method has been used to start the main motor M1 of the flyer frame, the main motor M1 can be started as shown in FIGS. 8 and 11 by the use of any one of the other known starting methods, such as reactor starting, stator resistance starting, primary voltage control (using thyristors), and motor pole number changing methods.

Furthermore, in these embodiments of this invention, the normal operation speed of the main motor M1 is generally within the limits of 800 r.p.m. to 1,100 r.p.m.; the low operation speed of the main motor M1 determined by the contactor $MS_C$ for the low speed operation changes between 200 r.p.m. and 300 r.p.m. (preferably about 250 r.p.m.) depending on the thickness of the rove; the set time of the times TR4 for defining the time period of the low speed operation may be about 15 sec. or more, preferably between 15 sec. and 20 sec. with a view to not decreasing the operation efficiency; and the set time of the timer TR3 for defining the time period during which the full voltage is impressed to the main motor terminals when starting is about 0.3 sec. to 0.4 sec., which assures that all the pressers can firmly contact the napped cloths of the bobbins.

What we claim is:

1. A method of starting a flyer frame, comprising the steps of effecting a cushion starting of the flyer frame and then allowing the normal speed operation of the flyer frame, wherein before the cushion starting is commenced, the flyer frame is driven for a predetermined time period at an operation speed which is lower than the normal operation speed of the flyer frame.

2. The method according to claim 1, wherein the predetermined time period is of sufficient length to allow any slack of a rove occurring during the cushion starting to be removed.

3. The method according to claim 1, wherein the flyer frame abruptly reaches said lower operation speed in a short period of time.

4. The method according to claim 1, wherein the flyer frame reaches its lower operation speed by being cushion started.

* * * * *